US008015814B2

(12) United States Patent
Callas et al.

(10) Patent No.: US 8,015,814 B2
(45) Date of Patent: Sep. 13, 2011

(54) TURBINE ENGINE HAVING FOLDED ANNULAR JET COMBUSTOR

(75) Inventors: James J. Callas, Peoria, IL (US); David J. White, La Mesa, CA (US)

(73) Assignee: Caterpillar Inc., Peoria, IL (US)

( * ) Notice: Subject to any disclaimer, the term of this patent is extended or adjusted under 35 U.S.C. 154(b) by 432 days.

(21) Appl. No.: 11/896,394

(22) Filed: Aug. 31, 2007

(65) Prior Publication Data

US 2008/0233525 A1 Sep. 25, 2008

Related U.S. Application Data

(60) Provisional application No. 60/854,038, filed on Oct. 24, 2006.

(51) Int. Cl.
*F02C 1/00* (2006.01)
*F02C 7/08* (2006.01)

(52) U.S. Cl. ..... 60/738; 60/737; 60/732

(58) Field of Classification Search ..... 60/738, 60/737, 739, 732, 776, 746, 758, 760; 431/353, 431/352

See application file for complete search history.

(56) References Cited

U.S. PATENT DOCUMENTS

| | | | | |
|---|---|---|---|---|
| 4,035,137 | A | 7/1977 | Arand | |
| 4,040,252 | A * | 8/1977 | Mosier et al. | 60/804 |
| 4,073,134 | A | 2/1978 | Koch | |
| 4,211,073 | A * | 7/1980 | Guillot | 60/746 |
| 4,300,480 | A | 11/1981 | Schoppe et al. | |
| 4,339,924 | A | 7/1982 | White et al. | |
| 4,351,156 | A | 9/1982 | White et al. | |
| 4,838,029 | A * | 6/1989 | Gleason et al. | 60/732 |
| 4,894,005 | A | 1/1990 | Keller | |
| 4,996,838 | A * | 3/1991 | Melconian | 60/804 |
| 5,069,029 | A * | 12/1991 | Kuroda et al. | 60/776 |
| 5,209,066 | A * | 5/1993 | Barbier et al. | 60/732 |
| 5,265,425 | A | 11/1993 | Howell | |
| 5,829,967 | A * | 11/1998 | Chyou | 431/350 |
| 5,850,732 | A | 12/1998 | Willis et al. | |
| 5,950,417 | A * | 9/1999 | Robertson et al. | 60/776 |

(Continued)

FOREIGN PATENT DOCUMENTS

EP 1167881 1/2002

(Continued)

OTHER PUBLICATIONS

A Jet Induced Circulation Combustor with Low $NO_x$ Emissions for an Automotive Gas Turbine Engine, White et al., IECEC Paper No. 729130, pp. 845-851, 1972.

(Continued)

*Primary Examiner* — Michael Cuff
*Assistant Examiner* — Gerald L Sung
(74) *Attorney, Agent, or Firm* — Finnegan, Henderson, Farabow, Garrett & Dunner LLP

(57) ABSTRACT

A combustor for a turbine engine is disclosed. The combustor may have a can-like dilution zone, a primary combustion zone, and a secondary combustion zone. The primary combustion zone may be disposed radially about the can-like dilution zone. The secondary combustion zone may be disposed at an end of the can-like dilution zone to fluidly communicate the primary combustion zone and the can-like dilution zone.

19 Claims, 3 Drawing Sheets

U.S. PATENT DOCUMENTS

| | | | | |
|---|---|---|---|---|
| 5,974,781 | A | 11/1999 | Correa et al. | |
| 6,109,038 | A * | 8/2000 | Sharifi et al. | 60/737 |
| 6,360,525 | B1 | 3/2002 | Senior et al. | |
| 6,374,594 | B1 | 4/2002 | Kraft et al. | |
| 6,931,862 | B2 * | 8/2005 | Harris | 60/804 |
| 7,062,917 | B2 | 6/2006 | Wunning et al. | |
| 7,107,772 | B2 | 9/2006 | Chen et al. | |
| 7,263,833 | B2 * | 9/2007 | Sanders | 60/776 |
| 7,284,378 | B2 * | 10/2007 | Amond et al. | 60/776 |
| 7,302,801 | B2 * | 12/2007 | Chen | 60/733 |
| 2002/0197574 | A1 | 12/2002 | Jones et al. | |
| 2004/0216463 | A1 * | 11/2004 | Harris | 60/776 |
| 2005/0034444 | A1 * | 2/2005 | Sanders | 60/39.23 |
| 2005/0188702 | A1 * | 9/2005 | Bachovchin et al. | 60/776 |
| 2005/0268618 | A1 * | 12/2005 | Johnson et al. | 60/776 |
| 2007/0151255 | A1 * | 7/2007 | Johnson et al. | 60/776 |
| 2009/0019855 | A1 * | 1/2009 | Venkataraman et al. | 60/738 |
| 2010/0162710 | A1 * | 7/2010 | Senior et al. | 60/737 |

FOREIGN PATENT DOCUMENTS

| | | |
|---|---|---|
| EP | 1659338 | 5/2006 |
| GB | 577865 | 6/1946 |
| WO | 03091626 | 11/2003 |

OTHER PUBLICATIONS

Low Emission Variable Area Combustor for Vehicular Gas Turbines, White et al., ASME Paper No. 73-GT-19, pp. 191-198, 1973.

Advanced Low $NO_x$ Combustors for Supersonic High-Altitude Aircraft Gas Turbines, Roberts et al., ASME Paper No. 76-GT-12, pp. 1-19, 1976.

Advanced Low $NO_x$ Combustors for Aircraft Gas Turbines, Roberts et al., AIAA Paper No. 76-764, pp. 1-17, 1976.

Evaluation of a Premixed, Prevaporized Gas Turbine Combustor for No. 2 Distillate, Teixeira et al., ASME Paper No. 77-GT-69, pp. 1-8, Mar. 1977.

Autoignition and Vaporization of No. 3 Diesel Oil Spray under Lean Conditions, White et al., ASME Paper No. 80-GT-10, pp. 1-8, 1980.

Low $NO_x$ Combustion Systems for Burning Heavy Residual Fuels and High-Fuel-Bound Nitrogen Fuels, White et al., ASME Paper No. 81-GT-109, pp. 377-385, 1982.

Development of a Dry Low NOx Combustor for 2-MW Class Gas Turbine, Hosoi et al., ASME Paper No. 96-GT-53, pp. 1-9, 1996.

Product Recirculation and Mixing Studies in a Stagnation Point Reverse Flow Combustor, Bobba et al., AIAA Paper No. 2007-0173, pp. 1-13, 2007.

* cited by examiner

TURBINE ENGINE HAVING FOLDED ANNULAR JET COMBUSTOR

RELATED APPLICATIONS

The present disclosure claims the right to priority based on U.S. Provisional Patent Application No. 60/854,038 filed Oct. 24, 2006.

TECHNICAL FIELD

The present disclosure relates generally to a turbine engine, and more particularly, to a turbine engine having a jet combustor with a folded annular combustion zone.

BACKGROUND

Internal combustion engines, including diesel-fueled engines, gaseous-fueled engines, and other engines known in the art, exhaust a complex mixture of air pollutants. These air pollutants are composed of gaseous compounds, which include, among other things, the oxides of nitrogen (NOx). Due to increased attention on the environment, exhaust emission standards have become more stringent and the amount of NOx emitted to the atmosphere from an engine may be regulated depending on the type of engine, size of engine, and/or class of engine.

It has been established that a turbine engine having a well-distributed flame and low flame temperature can reduce NOx production to levels compliant with current emission regulations. One way to generate a well-distributed flame with a low flame temperature is to use a pre-combustor that vaporizes fuel and heats air for mixture to a predetermined lean fuel-to-air equivalence ratio before injection into a primary combustor. However, pre-combusting requires complex and expensive designs, and the pre-combustion process often excites instabilities that can damage the engine.

One alternative to pre-combusting that has been implemented by engine manufacturers includes injecting the fuel and air into a pre-mixer, along with a flow of hot combustion gases, and then relying on the combustor's internal shape to force the required mixing before ignition occurs. An example of this strategy is described in U.S. Pat. No. 4,351,156 (the '156 patent) issued to White et al. on Sep. 28, 1982. The '156 patent describes a turbine engine having a primary combustion zone, a can-like secondary combustion zone, a dilution zone, and a pre-mixer. Air and fuel are introduced into the pre-mixer in a co-flow relationship, and hot exhaust gases are directed from the primary combustion zone through a bleed port into the pre-mixer. All three fluids then reverse flow directions and enter the primary combustion zone in a direction toward a dome of the zone, where the flow again reverses its direction and flows toward the secondary combustion and dilution zones. This flow reversing is designed to promote complete vaporization of the fuel and uniform mixing of the latter with the air.

Although the turbine engine and combustor arrangement described in the '156 patent may result in low NOx production without a pre-combustor, it may still be complex, costly, bulky, and have suboptimal mixing. In particular, because the combustor arrangement of the '156 patent requires a bleed flow of hot exhaust gases for fuel vaporization, the combustor arrangement is required to have additional passageways to accommodate these flows. The additional passageways increase the number of components, assembly complexity, and cost associated with the turbine engine. In addition, because the pre-mixer is located entirely outside of the combustor and, because the primary combustion zone is axially located relative to the secondary combustion zone, significant space on the turbine engine may be consumed thereby. Further, the flow reversals provided by the combustor arrangement of the '156 patent may be insufficient to optimally mix the fuel and air.

The disclosed combustor and turbine engine are directed to overcoming one or more of the problems set forth above.

SUMMARY OF THE INVENTION

In one aspect, the present disclosure is directed to a combustor. The combustor may include a can-like dilution zone, a primary combustion zone, and a secondary combustion zone. The primary combustion zone may be disposed radially about the can-like dilution zone. The secondary combustion zone may be disposed at an end of the can-like dilution zone to fluidly communicate the primary combustion zone and the can-like dilution zone.

In another aspect, the present disclosure is directed to a method of operating a combustor. The method may include directing a mixture of compressed air and fuel radially into the combustor toward a centerline of the combustor and in a first axial direction from a plurality of annular locations. The method may also include igniting the mixture, and redirecting the ignited mixture in a second axial direction opposite the first axial direction. The method may further include redirecting the ignited mixture back in the first axial direction.

DETAILED DESCRIPTION

Figure 1:
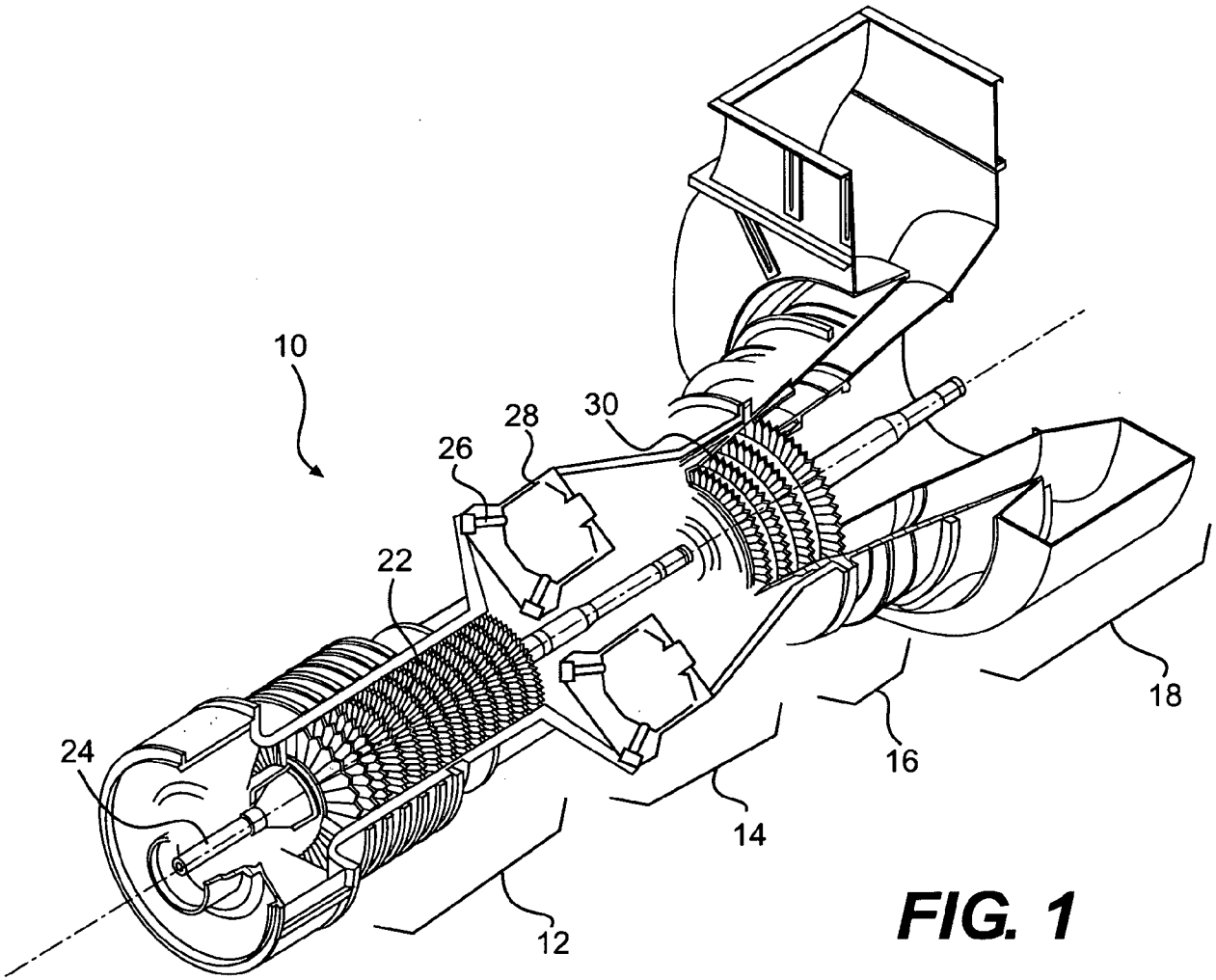
FIG. 1 is a cutaway-view illustration of an exemplary disclosed turbine engine.

FIG. 1 illustrates an exemplary turbine engine 10. Turbine engine 10 may be associated with a stationary or mobile machine configured to accomplish a predetermined task. For example, turbine engine 10 may embody the primary power source of a generator set that produces an electrical power output or of a pumping mechanism that performs a fluid pumping operation. Turbine engine 10 may alternatively embody the prime mover of an earth-moving machine, a passenger vehicle, a marine vessel, or any other mobile machine known in the art. Turbine engine 10 may include a compressor section 12, a combustor section 14, a turbine section 16, and an exhaust section 18.

Compressor section 12 may include components rotatable to compress inlet air. Specifically, compressor section 12 may include a series of rotatable compressor blades 22 fixedly connected about a central shaft 24. As central shaft 24 is rotated, compressor blades 22 may draw air into turbine engine 10 and pressurize the air. This pressurized air may then be directed toward combustor section 14 for mixture with a liquid and/or gaseous fuel. It is contemplated that compressor section 12 may further include compressor blades (not shown) that are separate from central shaft 24 and remain stationary during operation of turbine engine 10.

Combustor section 14 may mix fuel with the compressed air from compressor section 12 and combust the mixture to create a mechanical work output. Specifically, combustor section 14 may include a plurality of combustors 28 annularly arranged about central shaft 24, each having a plurality of premixing ports 26. Each premixing port 26 may inject one or both of liquid and gaseous fuel, and compressed air from compressor section 12 for ignition within its associated combustor 28. As the fuel/air mixture combusts, the heated molecules may expand and move at high speed into turbine section 16.

Turbine section 16 may include components rotatable in response to the flow of expanding exhaust gases from combustor section 14. In particular, turbine section 16 may include a series of rotatable turbine rotor blades 30 fixedly connected to central shaft 24. As turbine rotor blades 30 are bombarded with high-energy molecules from combustor section 14, the expanding molecules may cause central shaft 24 to rotate, thereby converting combustion energy into useful rotational power. This rotational power may then be drawn from turbine engine 10 and used for a variety of purposes. In addition to powering various external devices, the rotation of turbine rotor blades 30 and central shaft 24 may drive the rotation of compressor blades 22.

Exhaust section 18 may direct the spent exhaust from combustor and turbine sections 14, 16 to the atmosphere. It is contemplated that exhaust section 18 may include one or more treatment devices configured to remove pollutants from the exhaust and/or attenuation devices configured to reduce the noise associated with the combustion processes of turbine engine 10, if desired.

Figure 2:
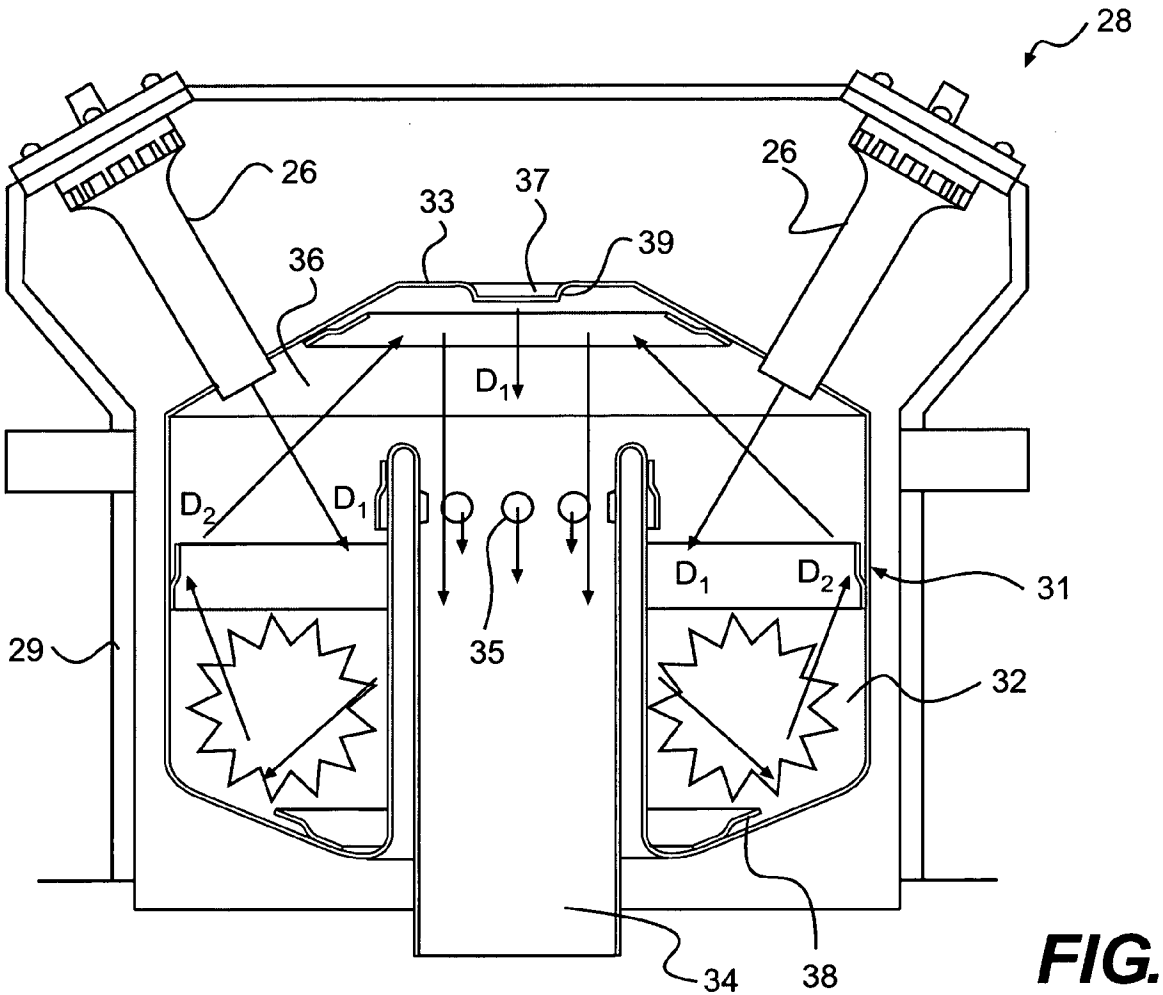
FIG. 2 is a cross-sectional illustration of an exemplary disclosed combustor for the turbine engine of FIG. 1.

The cross-section of FIG. 2 illustrates one embodiment of a folded-annular jet induced circulation ("FAJIC") combustor 28. This hybrid-type combustor 28 may include a combustor liner 31 disposed within a combustor casing 29. Combustor casing 29 may be fixedly attached to combustor section 14 of turbine engine 10 by one of several methods known in the art. Combustor liner 31 may be formed to include an annular primary combustion zone 32, a can-like dilution zone 34, a secondary combustion zone 36, and a plurality of premixing ports 26. As illustrated in FIG. 2, annular primary combustion zone 32 may be an annular chamber that surrounds can-like dilution zone 34 such that an inner wall of annular primary combustion zone 32 is disposed opposite an outer wall of can-like dilution zone 34. Can-like dilution zone 34 may be in the shape of a cylindrical tube. In particular, combustor liner 31 may be folded over on itself to form annular primary combustor zone 32, which may be concentric with and outside of, can-like dilution zone 34. It is this geometry that has given the name of "folded annular combustor" to this type of configuration. A splash-plate cooling ring 38, as illustrated in FIG. 2, may also be disposed about an end of annular primary combustion zone 32 farthest away from the location at which combustion liner 31 folds over on itself to divide annular primary combustion zone 32 from can-like dilution zone 34. Can-like dilution zone 34 may have disposed therein a plurality of dilution ports 35. As illustrated in FIG. 2, dilution ports 35 may be formed, annularly, in the cylindrical portion of combustion liner 31 constituting can-like dilution zone 34. Dilution ports 35 may be arranged at radial intervals about can-like dilution zone 34 depending on desired levels of dilution.

Moreover, as illustrated in FIG. 2, secondary combustion zone 36 may occupy a transition section between annular primary combustion zone 32 and can-like dilution zone 34. Secondary combustion zone 36 may be defined by a dome portion 33 of combustor liner 31 and by the volume between annular primary combustion zone 32 and can-like dilution zone 34. Accordingly, secondary combustion zone 36 may be located to direct a flow of combustion gases from annular primary combustion zone 32 to can-like dilution zone 34. In particular, secondary combustion zone 36 may have disposed therein a dilution port 37. Dilution port 37 may be a circular hole including a flange 39 formed in the center of dome portion 33. Range 39 may be oriented to redirect combustion gases by about 180" from a direction of flow through annular primary combustion zone 32 to a direction of flow through can-like dilution zone 34. In one embodiment, dilution port 37 may be formed by punching a hole through dome portion 33.

Combustor 28 may also include a plurality of individual premixing ports 26 for air-fuel preparation and premixing. The lengths of premixing ports 26 may be chosen to provide as complete premixing of air and fuel as possible without creating problems of auto-ignition or flashback. The actual lengths of premixing ports 26 may be dependent on the fuel employed and on the gas turbine cycle conditions at the combustor inlet. For example, gaseous fuels, such as natural gas, may only require premixing ports of 3.5 to 4 port diameters in length to provide near complete mixing at typical fuel-air ratios. Liquid fuels, such as JP-9, however, may require lengths of 10 port diameters at temperatures around 800° F., and 8 port diameters at 1000° F., to completely vaporize the liquid. Premixing port diameters and numbers may be based on the allowable combustor pressure drop, air density, air mass flow, and the predicted quenching diameter for the fuel air mixture and fuel type. Additional effects of local air temperature, pressure, and other parameters on auto-ignition and flashback will be apparent to one of ordinary skill in the art.

As illustrated in FIG. 2, premixing ports 26 may be fixedly mounted to combustor casing 29 at one end, as well as movably attached to combustor liner 31 at another end. Premixing ports 26 may be angled relative to a center axis of combustor 28 in order to produce jets that impact an inner wall of annular primary combustion zone 32. Such jets may create a strong recirculating flow within annular primary combustion zone 32. By this arrangement, each premixing port 26 may act as a separate flame stabilizing system provided that there is adequate separation between each one to prevent, or at least minimize, mutual entrainment. In general, mutual entrainment may be eliminated by preventing overlap of jets from premixing ports 26. Spacing of premixing ports 26 may therefore be determined by predicting jet diameters at the point of impact on the inner wall of annular primary combustion zone 32. Such an arrangement may allow fuel to be staged port-to-port without significantly changing emissions. Accordingly, a wide operating range may be obtained while maintaining nearly constant low emissions of criteria pollutants.

Alternative geometries embodying the main features of combustor liner 31 may also be used. For example, more rounded primary and secondary zone walls may be used instead of the generally flat metal sections shown. In one embodiment, which may be suitable for a 100-kW engine system, an outer diameter of combustor liner 31 may be about 14-inches, and an inner diameter thereof may be about 4-inches. Combustor liner 31 may be fabricated from either high temperature metal alloys, such as Hastelloy®-X or Haynes®-230, or other equivalent alloys or ceramic materials. When metallic alloys are employed, primary combustion zone 32 of combustion liner 31 may be coated with thermal barrier materials to allow the inner wall surfaces thereof to operate at the high temperatures. High temperature walls may be desirable for minimizing CO quenching and improving CO oxidation reactions in order to reduce CO emission levels. Because the liner wall may not be subject to severe forces, resistance to thermal shock may be more important than material strength for resistance to mechanical shock or loads.

Combustor 28 may thus be fabricated from materials such as low density silicon carbide, other ceramics, or ceramic composites with similar properties.

Combustor casing 29 may be fabricated from a wide variety of high-strength, high-temperature materials such as 300 and 400 series Stainless Steels. The actual geometry used for combustor casing 29 may largely depend on engine geometry and, in particular, whether or not a recuperator is incorporated into the system. The type and location of any recuperator, if incorporated, may play a major role in the selected geometry of combustor casing 29. For instance, a pathway for introducing heated air into an annular space between combustor liner 31 and combustor casing 29 may be necessary. Such a pathway could include a pipe (not shown) mounted to the engine, normal to the casing, at a point where the exhaust mates to the engine. Alternatively, the pipe may be disposed along a centerline between combustor casing 29 and a dome of combustor liner 31.

As illustrated in FIG. 2, a dome section of combustor casing 29 may be a separate piece for ease of installation. However, this configuration may be altered, such as by producing combustor casing 29 as a single integral piece. In addition, premixing ports 26, as shown, may be located in a large space between combustor liner 31 and combustor casing 29. However, the creation of individual cylindrical pots that surround each premixing port 26 may minimize this space. These cylindrical pots may be integral with combustor casing 29, welded to the combustor casing 29, or joined in some other way known in the art. The diameters of the cylindrical ports may be such that air flowing to the inlet of each premixing port 26 does not experience any significant pressure loss. The number of premixing ports 26 may be chosen such that their effective diameters are less than about 0.75-inch to minimize or eliminate the possibility of flashback and to maximize the mixing rates of fuel and air. Smaller port diameters may reduce the time required for the fuel and air to mix completely due to their shorter radial distances.

Figure 3:
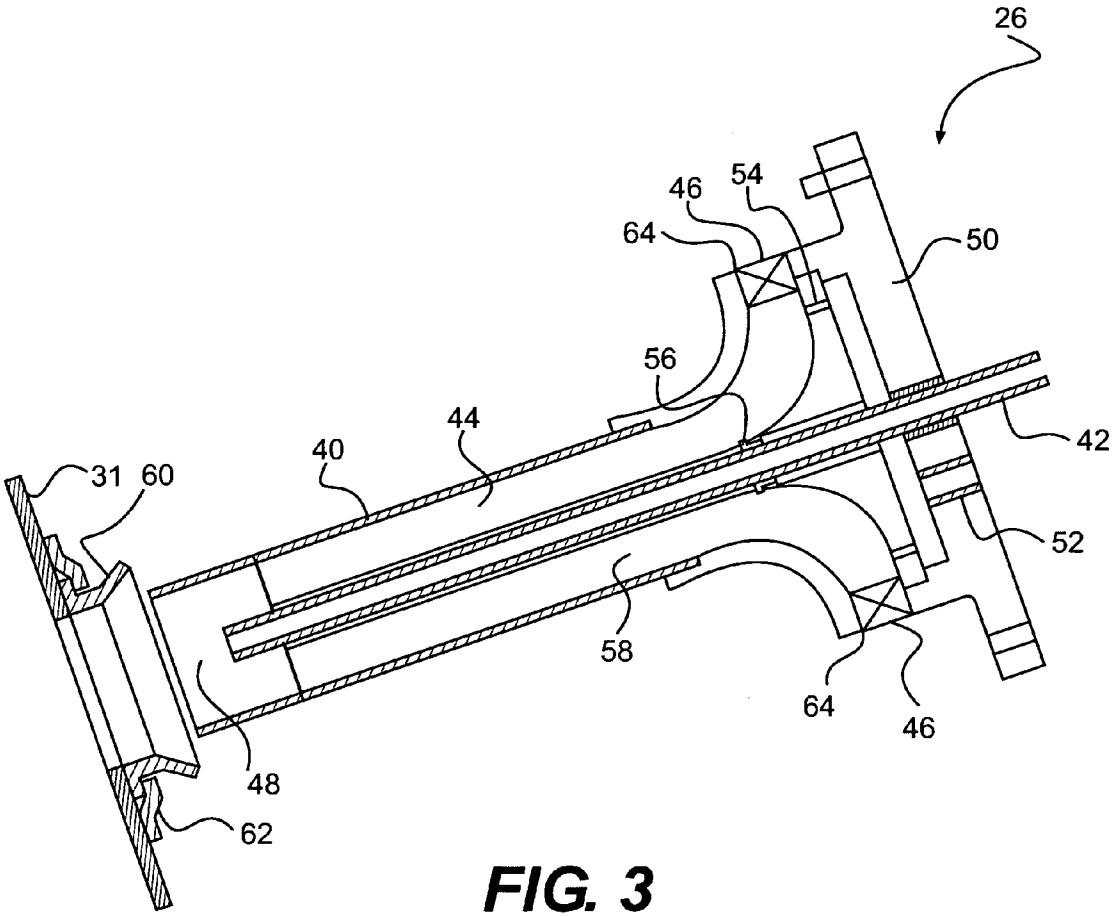
FIG. 3 is a cross-sectional illustration of an exemplary disclosed fuel nozzle for use with the combustor of FIG. 2.

FIG. 3 illustrates an exemplary embodiment of premixing port 26. Premixing port 26 may include a cylindrical main body 40 having a first end 48 proximate combustor liner 31, and a second end 58 fixedly mounted to a flange 50. Premixing port 26 may further include a central fuel inlet port 42 which may be disposed within and axially aligned with cylindrical main body 40. Central fuel inlet port 42 may provide fuel for a pilot or diffusion-type flame proximate or within first end 48 of cylindrical main body 40. In the embodiment of FIG. 3, central fuel inlet port 42 may be supported within cylindrical main body 40 by a plurality of support vanes 44. Support vanes 44 may extend along the length of, and project radially from, central fuel inlet port 42. Support vanes 44 may divide a volume, defined between cylindrical main body 40 and central fuel inlet port 42, to create a plurality of air inlet ports 46. Air inlet ports 46 may therefore extend between openings 64 in flange 50 and a first end 48 of cylindrical main body 40 proximate combustor liner 31. Air inlet ports 46 may therefore provide a supply of air, which is directed into substantially straight, non-swirling pathways in the annular cross-section between central fuel inlet port 42 and cylindrical main body 40.

Premixing port 26 may further include a main fuel inlet port 52 disposed to convey fuel to both low-velocity fuel inlet ports 54 and primary fuel inlet ports 56. Low-velocity fuel inlet ports 54 may provide fuel proximate the entryways of air inlet ports 46. In particular, low-velocity fuel inlet ports 54 may be disposed in flange 50 and oriented radially outward from a central axis of central fuel inlet port 42. Low-velocity fuel inlet ports 54 may also be disposed axially closer to flange 50 than air inlet ports 46. Primary fuel inlet ports 56 may inject fuel radially, or normally, outward into the air stream of air inlet ports 46. Primary fuel inlet ports 56 may be disposed adjacent an outer wall of central fuel inlet port 42 and at a radially inner portion of air inlet ports 46. Thus, primary fuel inlet ports 56 may be disposed downstream from low-velocity fuel inlet ports 54 and axially farther from flange 50 than both low-velocity fuel inlet ports 54 and air inlet ports 46. Accordingly, primary fuel inlet ports 56 may be disposed at a location within air inlet ports 46 in which air is flowing at a higher velocity than it flows adjacent low-velocity fuel inlet ports 54. Premixing port 26 may, therefore, provide fuel at an end of central fuel inlet port 42, at primary fuel inlet ports 56, and at low velocity fuel inlet ports 54.

As illustrated in FIGS. 2 and 3, premixing port 26 may be movably mounted between combustor casing 29 and combustor liner 31. Specifically, flange 50, to which second end 58 of cylindrical main body 40 is attached, may be fixedly mounted, such as via bolts, to combustor casing 29. First end 48 of cylindrical main body 40 may engage, such as by an interference fit, a machined grommet 60, which is movably secured to combustor liner 31 by a washer 62. Grommet 60 may traverse the surface of combustor liner 31 within the confines of washer 62, such that approaching components may be easily captured within an open-angled flange of grommet 60. Accordingly, premixing port 26 may be fixedly attached to combustor casing 29 at one end, and moveably engaged with grommet 60 of combustor liner 31 at the other end.

Washer 62 may, therefore, allow limited movement of premixing port 26 relative to combustor liner 31, which is sufficient to counter the effects of differential expansion between the two. Moreover, a pressure drop across combustor liner 31 may cause grommet 60 and cylindrical main body 40 to seal against combustor liner 31, thus minimizing any possible air leakage. Many other port mounting approaches may be used, such as, for example, bellows, ball-joints, and possible rigid mountings by which combustor liner 31 is allowed to expand both at a dome portion and at an exit portion, while remaining fixed relative to combustor casing 29.

INDUSTRIAL APPLICABILITY

The disclosed combustor and premixing port may be applicable to any turbine engine where improved fuel efficiency and reduced NOx emissions are desired. Although particularly useful for low NOx-emitting engines, the disclosed combustor and premixing port may be applicable to any turbine engine regardless of the emission output of the engine. The operation of turbine engine 10 will now be described.

During operation of turbine engine 10, air may be drawn into turbine engine 10 and compressed via compressor section 12 (referring to FIG. 1). This compressed air may then be directed to combustor section 14 to be mixed with fuel from premixing ports 26 of combustors 28 prior to combustion. As the mixture of fuel and air enters combustor 28, it may ignite and fully combust. The hot expanding exhaust gases may then be expelled into turbine section 16, where the molecular energy of the combustion gases may be converted to rotational energy of turbine rotor blades 30 and central shaft 24.

The disclosed combustors 28 of turbine engine 10 may mix fuel and air, and heat the mixture by redirecting it multiple times within each combustor 28 (referring to FIG. 2). The operation of combustor 28 will now be explained.

A mixture of fuel and air may be directed from the plurality of premixing ports 26, radially, into combustor 28, through combustor liner 31, toward a centerline of the combustor and in a first axial direction $D_1$. This gaseous mixture of compressed air may enter annular primary combustion zone 32 of combustor 28 and ignite at a location near splashplate cooling rings 38. There, the ignited mixture may be redirected in a second axial direction $D_2$ opposite first axial direction $D_1$ and toward secondary combustion zone 36. The gases leaving annular primary combustion zone 32 of combustor 28 may flow between the incoming air-fuel jets from adjacent premixing ports 26 and allow a large portion of the flow to be entrained by the jets. These entrained hot gases may provide a continuous ignition source for the incoming air-fuel jets. After passing through the incoming jets, the flow may enter secondary combustion zone 36 where CO may be allowed to oxidize further. To produce a more uniform gas mixture, secondary combustion zone 36 may employ a rapidly contracting 180-degree turn. The gases therein may be redirected back in the first axial direction $D_1$ to enter can-like dilution zone 34. Furthermore, a dilution air jet may be arranged to enter dome portion 33 at dilution port 37. Dilution port 37 may both stabilize the flow as it turns into the can-like dilution zone 34, and provide a reduction in gas temperatures. Further reduction in gas temperatures may be provided by dilution ports 35, located near the inlet to can-like dilution zone 34.

Several advantages over the prior art may be associated with combustor 28 of turbine engine 10. Because combustor 28 is a hybrid-type combustor, it may provide peripheral fuel staging even when mounted in the manner of a can type system, which traditionally requires separate zones axially disposed between the primary and dilution zones. Specifically, combustor 28 may be mounted on an engine in an axial configuration, while providing the advantages of an annular type system. Peripheral fuel staging may be arranged by mounting combustor 28 externally to the engine in a "silo", "sore-thumb", or "semi-enclosed rear mounting" manner for providing better access to premixing ports 26 and combustion liner 31. Such arrangements may also provide reduced development, maintenance, and repair costs.

Moreover, as shown in FIG. 2, this "folded annular" combustor 28 may allow separation and non-interaction of the air-fuel premixing ports 26. In a can-like primary zone arrangement, the jets issuing from the air-fuel premixing ports may merge on the combustor centerline. Conversely, in annular primary combustion zone 32, premixing ports 26 may be separated so that the jets do not mutually impinge. This separation may allow the jets leaving each of the ports 26 to create a separate recirculation vortex, essentially creating peripherally spaced individual primary zones. These separate zones, in turn, may allow the fuel to be staged between each of the premixing ports 26.

The disclosed premixing port 26 of combustors 28 may be applicable to any turbine engine combustor in which homogenous mixing of fuel and air is desired (referring to FIG. 3). The operation of premixing port 26 will now be explained.

As seen in FIG. 3, the flow path from air inlet ports 46 to cylindrical main body 40 may accelerate incoming compressed air to a velocity suitable for atomizing liquid fuels in a very short axial distance. This acceleration may also promote a high level of mixing within the air stream that tends to minimize or eliminate existing disturbances. Such disturbances, in the form of non-uniform velocity profiles, may have been generated upstream from air inlet ports 46 by obstructions, such as bends in the airflow path. Accordingly, the disclosed internal accelerating flow path may provide a near uniform velocity profile to the flow at the transition to cylindrical main body 40.

Uniform velocity airflow may then flow from second end 58 of cylindrical main body 40 to first end 48. Because of the radial injection of fuel into this airflow at primary fuel inlet ports 56, a sufficiently large center body (i.e., central fuel inlet port 42) may be required to accommodate the radial injection passages. In addition to supporting central fuel inlet port 42, vanes 44 may also be used to maintain a near constant effective flow area through the premixing port. This "blockage" by vanes 44 and by central fuel inlet port 42 along its length, may help to avoid expansions that could cause local flow separation and possible flame attachment points.

Vanes 44 may also deswirl the airflow, ensuring a near constant discharge coefficient for all of the ports. Without vanes 44, the air might naturally swirl within cylindrical main body 40, possibly causing the swirl direction and intensity to be different in each premixing port 26. Such differences in swirl rate and direction may create undesirably varying effective discharge coefficients and airflow rates sufficient to prevent maintenance of a near constant equivalence ratio across the ports.

In order to obtain optimal mixing, atomization, and jet penetration of the air-fuel mixture within premixing ports 26, liquid fuels may be injected into the compressed air at higher pressures than gaseous fuels. Specifically, the overall pressure drop across combustor 28 and the area of premixing ports 26 may be selected to provide a high air velocity suitable to produce an atomized spray with Sauter Mean drop diameters of less than 26-microns. For most liquid fuels, the required air pressure drop may be between 3.5% and 4.5%. Accordingly, because atomization quality may be strongly dependent on air velocity, liquid fuel may be advantageously injected into the highest velocity region of the airflow.

Alternatively, if premixing port 26 is to be used for premixing a gaseous fuel, such as natural gas, the fuel may be injected at low velocity fuel inlet ports 54 within the above described accelerating fuel path. Because mixing may depend on the square root of the momentum flux ratio of the gas jets to the airflow, injection at low air velocities may reduce the required level of gas injection pressures. Reductions in the required gas injection pressures may result in significant energy savings. Gas injection in such a location may also allow the premixing port 26 to be used for premixing both liquid and gaseous fuels.

Accordingly, in the premixing port 26 of FIG. 3, a dual fuel injection system may be used to provide light-off and low NOx full power operation. Specifically, because of the need to operate and maintain low emissions over a driving cycle that encompasses a wide range of load conditions, the disclosed combustor may employ two distinct range increasing techniques. The first technique may involve a piloting action within each port, while the second, which is optional but probably necessary if low NOx emissions are to be maintained over a wide load range, may involve staging fuel between premixing ports 26. These techniques may maintain low NOx emissions as the engine fuel flow is decreased to match low load conditions.

Still referring to FIG. 3, central fuel inlet port 42 may provide, for both gaseous and liquid fuels, a pilot-like effect to help stabilize the primary zone at very low (lean) fuel-air ratios. This simple co-axial fuel injection system may inject a small quantity of fuel (near the exit of premixing port 26) sufficient to create a small hot steak within the air fuel jet when it enters annular primary combustion zone 32 and ignites. The hot streaks produced, may allow annular primary combustion zone 32 to operate at average fuel-air ratios close to or below the lean extinction limit. The diffusion type flame produced by central fuel inlet port 42 may be ideal for ignition purposes during engine starting.

During starting, up to 5% of the full-load fuel flow may be injected via central fuel inlet port 42. After ignition has occurred, additional fuel may be added to combustor 28 through primary fuel injection ports 56 to accelerate turbine engine 10. This fuel may premix with the air and the diffusion flame combustion products and then ignite. The wide range of fuel air ratios provided by the poorly atomized and mixed secondary fuel and primary air may provide ideal conditions for ignition. Generally, the velocities within the annular primary combustion zone 32 may be low because of the need to provide adequate residence times for the oxidation of carbon monoxide (at high loads). These oxidation reactions may be very slow at the temperatures required to minimize NOx emissions and thus they may require long residence times. These low velocities, when combined with a wide range of fuel air ratios, may further enhance the ignition process by allowing the ignited flame kernel to grow. This two stage fuel injection may provide stable operation from light-off to the point where self sustaining operation can occur.

The above described combustion system may, at maximum load, have airflow splits and a total fuel flow that produces a primary zone temperature on the order of 2800 F. This condition may provide the needed brake specific NOx emission levels of about 0.3-g/hp·h and carbon monoxide concentrations of around 0.05-g/hp·h.

In operation, main fuel inlet port 52 to each premixing port 26 of combustor 28 may be turned off completely, and central fuel inlet port 42 left on, to ensure stable ignition when primary fuel flow is restarted. In response to a lower load requirement, the fuel flow may be decreased in one, or possibly two, of premixing ports 26 until the fuel-air ratio reaches a limit set so that the flame associated with each of the ports does not extinguish. Accordingly, if a lower fuel flow is required, main fuel inlet flow may be quickly and completely turned off. The use of such an approach is anticipated as a means of minimizing the emission of unburned products such as carbon monoxide (CO). It may be possible to simply gradually reduce the fuel to zero if the CO burn-out time is sufficient in secondary combustion zone 36 and can-like dilution zone 34. Alternatively, if necessary, the fuel flow to the remaining premixing ports 26 may be increased slightly to provide an intermediate fuel flow.

In one embodiment, combustor 28 may include six premixing ports 26 with fuel modulated to three of them to provide turndown from full load to around 50% load. At loads below 50%, these three premixing ports 26 may have substantially no primary fuel supplied to them. The combustion processes at conditions approaching no-load, thus, may become dominated by diffusion type flames that provide a wide, stable operating range, but produce high NOx emissions. To shut the engine down, the primary fuel flow may be turned off before the secondary flow. In an emergency shutdown, both fuel flows may be turned off simultaneously.

Several advantages over the prior art may be associated with premixing port 26 of turbine engine 10. Specifically, premixing port 26 may overcome cooling problems by premixing air and fuel and injecting this mixture against the combustor dome. Each premixing port may therefore act as a separate flame stabilizing system so long as there is sufficient separation between each premixing port (i.e., so as to prevent mutual entrainment). Moreover, premixing port 26 may potentially allow the use of either liquid or gaseous fuels. Alternatively, the design of premixing port 26 may allow dual fuel operation, if it is so desired. The capability of switching from one fuel to another, such as a change from a kerosene type fuel to a natural gas, during actual engine operation may also be possible.

It will be apparent to those skilled in the art that various modifications and variations can be made to the disclosed combustor and turbine engine. Other embodiments will be apparent to those skilled in the art from consideration of the specification and practice of the disclosed combustor and turbine engine. It is intended that the specification and examples be considered as exemplary only, with a true scope being indicated by the following claims and their equivalents.

What is claimed is:

1. A combustor, comprising:

a can-like dilution zone disposed along a central axis of the combustor;

a primary combustion zone disposed radially about the can-like dilution zone;

a secondary combustion zone disposed at an end of the can-like dilution zone to fluidly communicate the primary combustion zone and the can-like dilution zone; and at least one premixing port configured to direct a fuel and air mixture toward the primary combustion zone;

wherein the primary combustion zone includes at least one redirecting surface configured to direct combusting gasses across the fuel air mixture and into the secondary combustion zone.

2. The combustor of claim 1, wherein the at least one premixing port is disposed within the secondary combustion zone.

3. The combustor of claim 2, wherein the primary combustion zone is annular and the at least one premixing port is configured to direct the fuel and air mixture from the secondary combustion zone into the primary combustion zone toward a centerline of the can-like dilution zone.

4. The combustor of claim 3, wherein the at least one redirecting surface of the primary combustion zone includes a plurality of redirecting surfaces configured to reverse a flow of the fuel and air mixture from the primary combustion zone back toward the secondary combustion zone.

5. The combustor of claim 4, wherein the secondary combustion zone includes a flange configured to again reverse a flow direction of the fuel and air mixture from the secondary combustion zone into the can-like dilution zone.

6. The combustor of claim 4, wherein the at least one premixing port includes a plurality of premixing ports annularly disposed about the secondary combustion chamber and the flow of fuel and air from a first of the plurality of premixing ports, when reversing flow direction from the primary combustion zone into the secondary combustion zone, passes between incoming flows of fuel and air directed from the secondary combustion zone into the primary combustion zone by adjacent ones of the plurality of premixing ports.

7. The combustor of claim 2, wherein the at least one premixing port includes a plurality of premixing ports annularly disposed about the secondary combustion zone such that a plurality of fuel and air flows are maintained separate from the primary combustion zone into the secondary combustion zone.

8. The combustor of claim 7, wherein at least one of the plurality of fuel and air flows may be independently modulated without substantially affecting the adjacent ones of the plurality of fuel and air flows.

9. The combustor of claim 2, wherein the at least one premixing port includes:

a cylindrical main body having a first end open to the secondary combustion chamber, and a second closed end;

an air inlet port disposed proximal the second closed end; and a plurality of fuel inlet ports.

10. The combustor of claim 9, wherein a first of the plurality of fuel inlet ports is located proximal the second closed end and a second of the plurality of fuel inlet ports is located an axial distance away from the first inlet port toward the first open end.

11. The combustor of claim 10, wherein a majority of the fuel directed into the combustor is directed via the first of the plurality of fuel inlet ports.

12. The combustor of claim 11, wherein the fuel directed into the combustor via the second of the plurality of fuel inlet ports is substantially unmixed with air prior to entering the primary combustion zone.

13. The combustor of claim 9, wherein the at least one premixing port further includes a plurality of radially projecting support vanes dividing the cylindrical main body into a plurality of passageways.

14. The combustor of claim 9, wherein the at least one premixing port is flexibly connected to a wall of the secondary combustion zone.

15. The combustor of claim 1, further including a dilution port disposed within a dome portion of the secondary combustion zone to selectively pass an air jet axially into the can-like dilution zone.

16. The combustor of claim 1, further including a plurality of dilution ports radially disposed within the can-like dilution zone to selectively pass a plurality of air jets radially into the can-like dilution zone.

17. A turbine engine, comprising:

a compressor section configured to pressurize inlet air;

a turbine section driven by exhaust to rotate the compressor section; and a combustor configured to ignite the pressurized inlet air and a flow fuel to produce the exhaust, the combustor including:

a can-like dilution zone;

a primary combustion zone disposed radially about the can-like dilution zone;

a secondary combustion zone disposed at an end of the can-like dilution zone to fluidly communicate the primary combustion zone and the can-like dilution zone; and at least one premixing port disposed within the secondary combustion zone and configured to direct a flow of fuel and air into the primary combustion zone toward a centerline of the can-like dilution zone;

wherein the primary combustion zone includes at least one redirecting surface configured to direct combusting gasses across the fuel air mixture and into the secondary combustion zone.

18. The turbine engine of claim 17, further comprising a dilution port disposed within a dome portion of the secondary combustion zone.

19. A combustor, comprising:

a can-like dilution zone disposed along a central axis of the combustor and having an upstream end and an open downstream end;

a primary combustion zone disposed radially about the can-like dilution zone;

a secondary combustion zone disposed adjacent to the upstream end of the can-like dilution zone to fluidly communicate the primary combustion zone and the can-like dilution zone; and one or more premixing ports disposed at an angle having a first angular component radially toward the central axis and a second angular component axially toward the downstream end of the can-like dilution zone.

* * * * *